US006694906B1

(12) United States Patent
Buck

(10) Patent No.: US 6,694,906 B1
(45) Date of Patent: Feb. 24, 2004

(54) APPARATUS, SYSTEM, AND METHOD FOR ADAPTING A CAP FRAME SASH TO BE QUICKLY MOUNTED TO AND DISMOUNTED FROM A TUBULAR FRAME SASH ON AN AUTOMATIC EMBROIDERY MACHINE

(76) Inventor: James Buck, 6701 Chelsea Ct., Fort Worth, TX (US) 76132

( * ) Notice: Subject to any disclaimer, the term of this patent is extended or adjusted under 35 U.S.C. 154(b) by 0 days.

(21) Appl. No.: 10/428,569

(22) Filed: May 2, 2003

(51) Int. Cl.[7] ..... D05C 9/04; D05C 5/02; D05B 21/00

(52) U.S. Cl. ..... 112/475.19; 112/102.5; 112/168

(58) Field of Search ..... 112/475.19, 475.18, 112/475.11, 470.14, 103, 168, 63, 102.5, 470.06; 38/102.91, 102.2

(56) References Cited

U.S. PATENT DOCUMENTS 5,860,374 A 1/1999 Jensen et al.
5,862,765 A 1/1999 Grundl
6,457,428 B1 * 10/2002 Vickroy ..... 112/103

* cited by examiner

*Primary Examiner*—Peter Nerbun
(74) *Attorney, Agent, or Firm*—Michael E. Noe, Jr.; Bracewell & Patterson, L.L.P.

(57) ABSTRACT

A system for converting an automatic embroidery machine from one type of work to another type of work is disclosed. The invention adapts a cap frame sash or driver unit or sash to be quickly mounted to and dismounted from a tubular frame sash or holder. The cap frame sash has additional braces so that the cap frame sash snaps into a tubular frame sash. The tubular frame sash has clips that engage the additional braces on the cap frame sash in a quick-release fashion. There is no need to remove the tubular frame sash from the machine to embroider caps. The flat work frame is simply snapped out of the clips of the tubular frame sash, and the cap frame driver or sash is snapped into the tubular frame sash. The invention uses spring clips, registration pins, and complementary sockets. No fasteners are required since a single type of sash is able to accommodate more than one type of workpiece frame when the embroidery machine is reconfigured.

17 Claims, 5 Drawing Sheets

APPARATUS, SYSTEM, AND METHOD FOR ADAPTING A CAP FRAME SASH TO BE QUICKLY MOUNTED TO AND DISMOUNTED FROM A TUBULAR FRAME SASH ON AN AUTOMATIC EMBROIDERY MACHINE

BACKGROUND OF THE INVENTION

1. Technical Field

The present invention relates in general to an improved system for converting an automatic embroidery machine from one type of work to another type of work and, in particular, to an improved apparatus, system, and method for adapting a cap frame driver unit or sash so that it can be quickly mounted to and dismounted from the tubular frame holder, arms, or sash on an automatic embroidery machine.

2. Description of the Prior Art

An automated embroidery machine has one or more heads for performing embroidery functions on a workpiece, such as garment or hat. The head contains needles with different colors of thread for stitching a design on the workpiece. The head is mounted to a chassis and is stationary. A mechanized carriage is located adjacent to the head for manipulating a sash through a range of motions. The sash extends outward from the chassis directly below the head. The sash receives and retains a frame which supports the workpiece itself. The carriage thereby moves the sash and frame to articulate the workpiece relative to the head. The workpiece is secured to the frame so that it can be precisely moved by a carriage as intricate embroidery operations are performed. The movement of the carriage is controlled by commands from a computer.

Typical embroidery machines require a different sash and frame for the various types of workpieces. For example, if the workpiece is a garment that can be readily stretched flat, such as a shirt or jacket (commonly referred to as "flat work"), the fabric of the garment is usually placed in and stretched flat by a hoop-type frame. Another type of attachment or frame is used for embroidering caps, which cannot be readily stretched flat by a hoop due to their curvature. The term "cap" as used herein refers to all types of headgear on which embroidering is performed, including certain hats.

The requirement of a different sash and frame for each type of workpiece causes a significant delay when the embroidery machine has to be reconfigured from, for example, flat work to caps. In order to remove the flat work components, numerous screws or other fasteners must be manually removed from the tubular sash and carriage. The cap sash and frame are then installed by a similar process by attaching them to the carriage with fasteners. This sequence of steps may need to be repeated for each head on an embroidery machine. Thus, for an embroidery machine having many heads, the down time for the machine and the manual labor required to perform to the changeover are quite significant. Consequently, there is a need to make the adaptation of an embroidery machine from one type of workpiece to another type of workpiece much more efficient in the changeover process than the prior art allows. Such an improvement would be highly desirable in the embroidery business.

SUMMARY OF THE INVENTION

One embodiment of the present invention comprises an improved system for converting an automatic embroidery machine from one type of work to another type of work. In particular, the present invention is designed to adapt a cap frame driver unit or sash so that it can be quickly mounted to and dismounted from the tubular frame sash, holder or arms on an automatic embroidery machine. This function is achieved by configuring or modifying the arms of a cap frame sash with additional braces so that the cap frame sash, ideally, snaps into a tubular frame sash.

The tubular frame sash has arms that are equipped with clips that readily engage and disengage the additional braces on the cap frame sash in a quick-release fashion, as well as those of tubular frames. As a result, there is no need to remove the tubular frame sash from the embroidery machine when a user desires to embroider caps. Instead, the flat work frame is simply snapped out of the arm clips of the tubular frame sash, and the cap frame sash is snapped into the tubular frame sash in its place in its place.

The present invention makes use of spring clips, locating pins, and complementary sockets, so there is no need to remove or attach any fasteners. Thus, there is no longer a requirement to remove tubular sash for each type of workpiece when the embroidery machine is reconfigured to embroider a different type of workpiece. An embroidery machine equipped with the sashes and frames constructed in accordance with the present invention is much more efficient during changeover than prior art devices.

The foregoing and other objects and advantages of the present invention will be apparent to those skilled in the art, in view of the following detailed description of the preferred embodiment of the present invention, taken in conjunction with the appended claims and the accompanying drawings.

BRIEF DESCRIPTION OF THE DRAWINGS

So that the manner in which the features and advantages of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE PRESENT INVENTION

Figure 1:
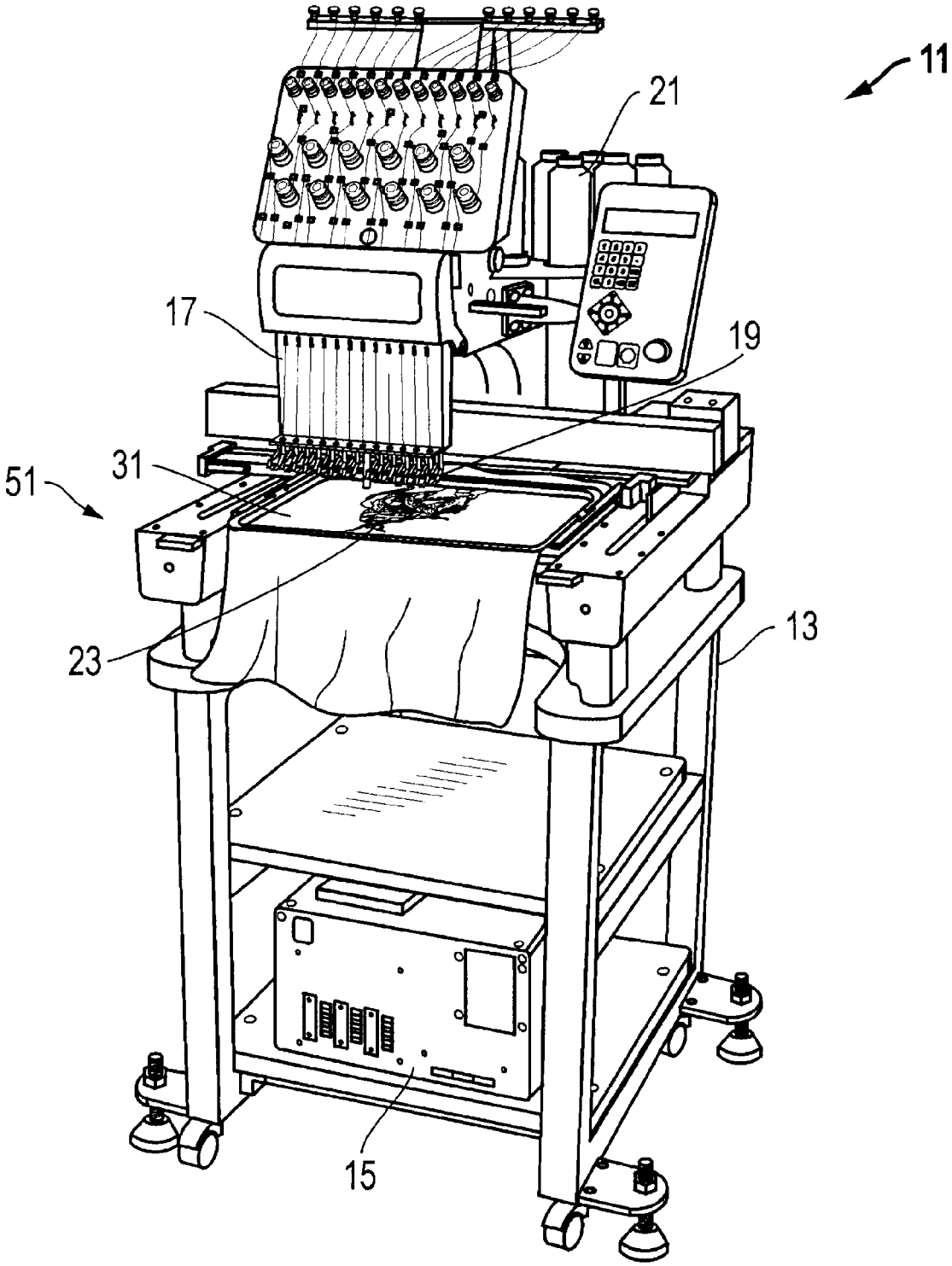
FIG. 1 is an isometric view of one embodiment of an automatic embroidery machine shown embroidering a flat work workpiece and is constructed in accordance with the present invention.
Figure 2:
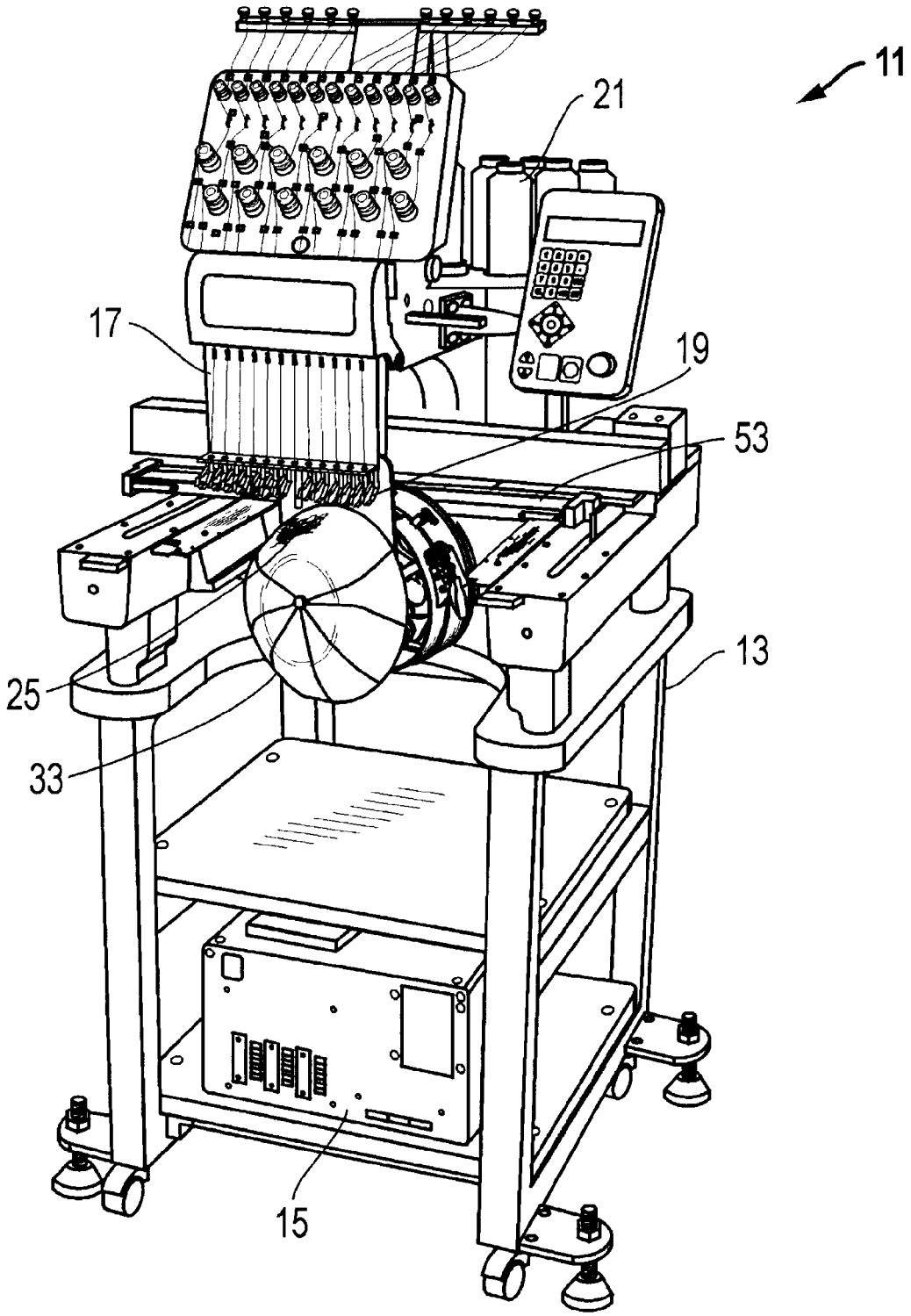
FIG. 2 is an isometric view of the automatic embroidery machine of FIG. 1 shown embroidering a cap workpiece and is constructed in accordance with the present invention.

Referring to FIGS. 1 and 2, one embodiment of a system, method, and apparatus for converting an automatic embroidery machine 11 from one type of workpiece 31 (FIG. 1) to another type of workpiece 33 (FIG. 2), is shown. The automatic embroidery machine 11 has a chassis 13, a computer 15 mounted to the chassis 13, and at least one head 17 for performing embroidery functions on a workpiece. The head 17 has sewing needles 19 for sewing with different colors of thread 21 and stitching designs 23, 25 on the workpieces 31, 33, respectively. A carriage assembly 27 is also mounted to the chassis 13 and is located adjacent to the head 17. The carriage assembly 27 is movable relative to the chassis 13 and the head 17 in response to commands from the computer 15. Although automatic embroidery machine 11 is shown with only one head 17 and associated sets of components, it may utilize many more heads and components depending on the application.

Figure 3:
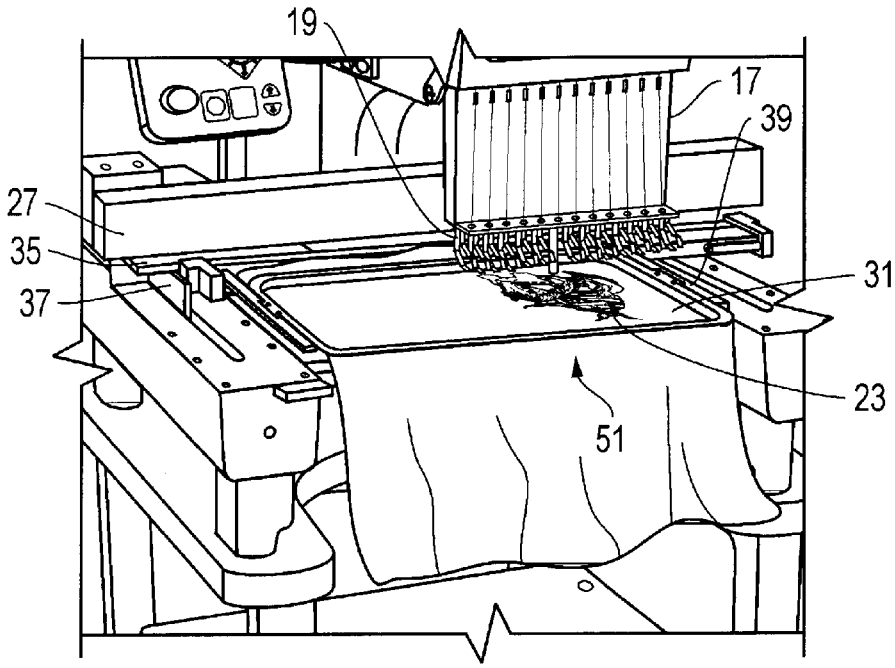
FIG. 3 is an enlarged isometric view of the flat work workpiece of FIG. 1 on the automatic embroidery machine and is constructed in accordance with the present invention.
Figure 4:
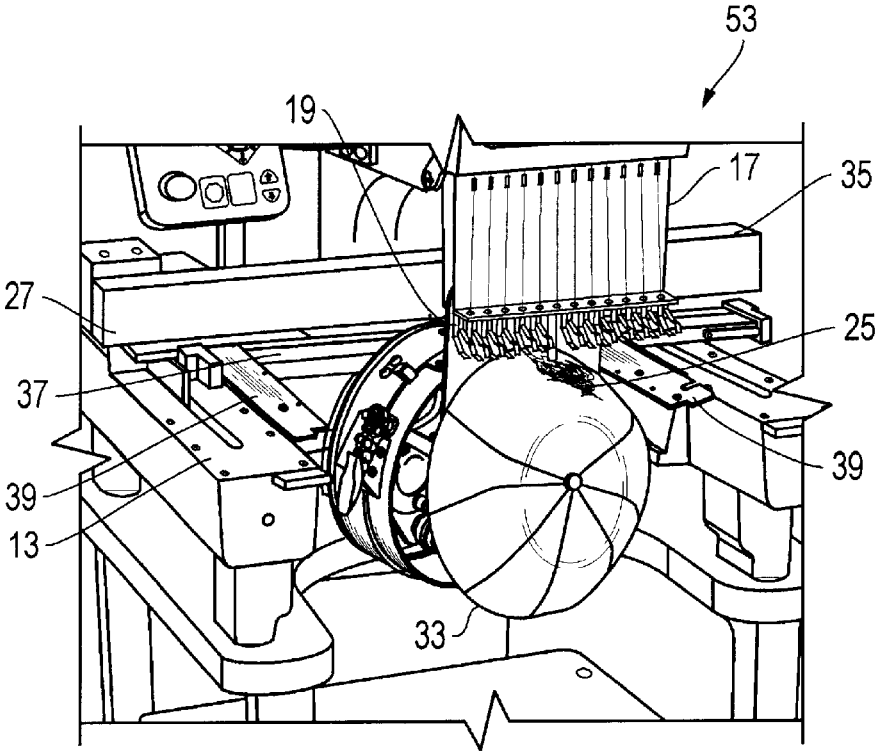
FIG. 4 is an enlarged isometric view of the cap workpiece of FIG. 2 on the automatic embroidery machine and is constructed in accordance with the present invention.
Figure 5:
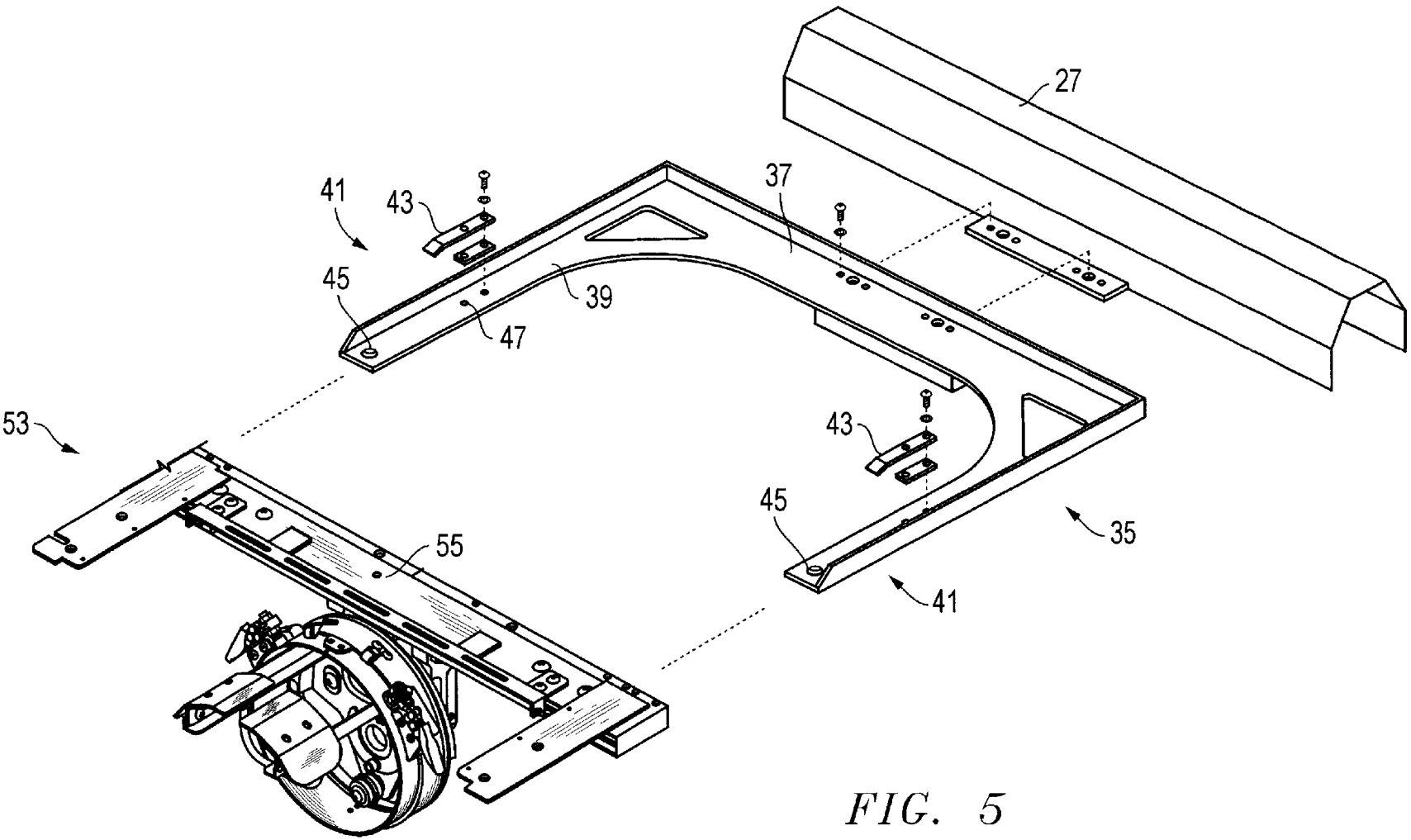
FIG. 5 is an exploded isometric view of a cap frame sash for the cap workpiece of FIG. 2 and a tubular sash on the automatic embroidery machine and is constructed in accordance with the present invention.
Figure 6:
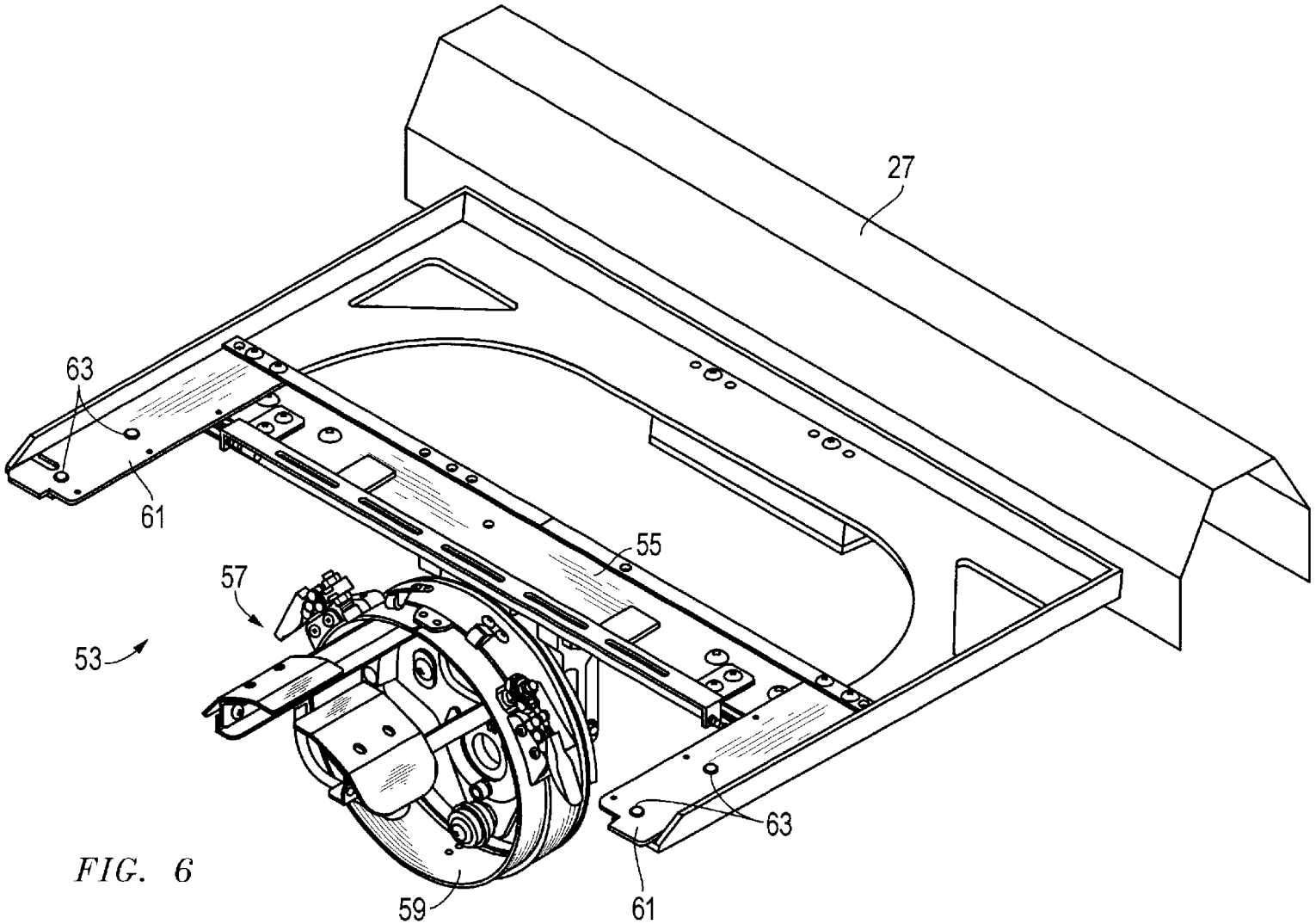
FIG. 6 is an isometric view of the cap frame mounted to the sash of FIG. 5 on the automatic embroidery machine and is constructed in accordance with the present invention.

As shown in FIGS. 3 and 4, a sash 35 is mounted (typically bolted) to the carriage assembly 27 for manipulation by the carriage assembly 27 through a range of motions. As will be described in greater detail below, this one sash 35 is designed to interchangeably receive, accommodate, and release at least two completely different types of workpieces, such as workpieces 31, 33. Moreover, the sash 35 also accommodates different sizes and styles of each of two types of workpieces 31, 33. In the embodiment shown, the sash 35 comprises a bracket 37 that mounts to the carriage assembly 27, and a pair of arms 39 that extend or protrude from the bracket 37. The sash 35 has quick-release features 41 that are used to interchangeably interconnect with the two different types of workpieces 31, 33. Ideally, the quick-release features 41 do not utilize threaded fasteners. Rather, the quick-release features 41 are designed to snap onto and off of the structures that support the workpieces 31, 33. For example, the quick-release features 41 of the embodiment shown comprise spring clips 43, registration pins 45, registration sockets 47, and still other types of quick-release feature such as those known in the art.

Two exemplary devices are used to secure and retain the workpieces 31, 33, respectively, are shown in the appended figures. In FIGS. 1 and 3, a tubular frame 51 is provided for securing and retaining a type of workpiece commonly known as a "flat work" workpiece 31, which was defined previously, between a set of tubular hoops. The tubular frame 51 may be releasably mounted to the sash 35 via the quick-release features 41 while supporting and retaining a flat work workpiece 31 therein. The design 23 is located within the perimeter of the tubular hoops.

In FIGS. 2, 4, 5, and 6, another type of device for securing the different type of workpiece 33 is shown. In the particular version shown, a cap frame sash 53 is used as an example. Cap frame sash 53 is designed to secure and retain the other type of workpiece which, in this version, is head wear workpiece 33 (also defined previously). The cap frame sash 53 may be releasably mounted to the tubular sash 35 via the quick-release features 41 while supporting and retaining a head wear workpiece 33. Clearly, tubular frame 51 and cap frame sash 53 differ substantially from each other because of the nature and shape of their respective workpieces 31, 33. Despite the differences between these devices, the flat work workpiece 31 and the head wear workpiece 33 are interchangeably mountable to the same quick-release features 41 of the sash 35 through their respective frames 51, 53.

In the embodiment shown, the cap frame sash 53 includes a bracket 55 that attaches to and extends forward from the sash 35. A cap driver 57 is movably secured to the bracket 55 for supporting a cap frame. The cap driver 57 is an assembly that moves in unison with the carriage assembly 27, when driven. The cap driver 57 also includes an arcuate member 59 that is pivotally rotatable relative to the carriage assembly 27. Movement of the carriage assembly 27 perpendicular to an axis of the cap driver 57 causes the arcuate member 59 to pivot rotatably about the axis. A cap, in a cap frame, 33 (FIGS. 2 and 4) is clamped onto the cap driver 57 and releasably fastened to the arcuate member 59. The framework of the cap driver positions a forward portion of the body of the cap 33 in an arcuate position. The carriage assembly 27 moves the cap driver 57 to embroider the forward portion of the body of the cap 33.

The cap frame sash 53 also has a set of braces 61 that extend from the bracket 55. The braces 61 extend from the bracket 55 in the same direction as the plurality of arms 39 that extend from the sash 35. The braces 61 engage respective ones of the plurality of arms 39 and the quick-release features 41 of the sash 35 to retain the cap frame sash 53 on the tubular sash 35. The cap frame sash 53 snaps onto and off of the tubular sash 35 in the same manner as the tubular frame 51. Each of the braces 61 has registration features 63 that are complementary to respective ones of the registration pins 45 and sockets 47.

In operation, a method of converting the automatic embroidery machine 11 from one type of workpiece 31 to another type of workpiece 33 is used. The method comprises providing the automatic embroidery machine 11 with a computer 15, a head 17, a carriage assembly 27, a tubular frame 51 supporting and retaining a flat work workpiece 31, and a second frame 53 (a cap frame is shown) supporting and retaining a second type of workpiece 33 (a cap is shown) that differs substantially from the flat work workpiece 31. As shown in the appended figures, the second frame 53 has a configuration other than a tubular frame 51.

The sash 35 is mounted to the carriage assembly 27. The sash has quick-release features 41 that, ideally, do not utilize threaded fasteners. Either the tubular frame 51 or the second frame 53 is then mounted to the tubular sash 35 via the quick-release features 41. The carriage assembly 27 is moved and, thus, either the tubular frame 51 or the second frame 53, depending on which is attached, is moved through a range of motions relative to the head 17 for performing embroidery operations with the head 17 on a respective one of the workpieces 31, 33, in response to commands from the computer 15.

After the embroidery is complete, the attached frame is released and removed from the sash 35, in the preferred embodiment, strictly by disengaging the quick-release features 41. No other fasteners need be removed to remove the frame from the sash 35. Once the first frame is removed, the second frame 53 is mounted to the sash 35 via the quick-release features 41, such that both the flat work workpiece 31 and the second type of workpiece 33 are interchangeably mountable to the same quick-release features 41 of the sash 35 through their respective frames 51, 53. When the subsequent frame is attached, the carriage assembly 27 and, thus, said other one of the tubular frame 51 and the second frame 53 are moved through a range of motions relative to the head 17 for performing embroidery operations on the respective other one of the workpieces 31, 33 in response to commands from the computer 15. Again, all mounting and dismounting of the frames 51, 53 comprise engaging and retaining them with the quick-release features 41 without utilizing threaded fasteners. Instead, the arms 39, spring clips 43, registration pins 45, and sockets 47 interchangeably engage and retain complementary features on the frames 51, 53.

The present invention has several advantages including the ability to convert an automatic embroidery machine from one type of work to another type of work. In particular, the present invention is designed to adapt a cap frame driver unit or sash so that it can be quickly mounted to and dismounted from a tubular frame sash or holder on an automatic embroidery machine. This function is achieved by configuring or modifying the arms of a cap frame sash with additional braces so that the cap frame snaps into a tubular frame sash. The tubular frame sash has arms that are equipped with clips that readily engage and disengage the additional braces on the cap frame sash in a quick-release fashion, as well as those of tubular frames. As a result, there is no need to remove the tubular frame sash from the embroidery machine when a user desires to embroider caps. Instead, the flat work frame is simply snapped out of the arm clips of the tubular frame sash, and the cap frame sash or driver is snapped into the tubular frame sash in its place.

The present invention makes use of spring clips, locating pins, and complementary sockets, so there is no need to remove or attach any fasteners. Thus, there is no longer a requirement to change from one type of sash to another for each type of workpiece when the embroidery machine is reconfigured to embroider a different type of workpiece. An embroidery machine equipped with the sashes and frames constructed in accordance with the present invention is much more efficient during changeover than prior art devices.

While the invention has been shown or described in only some of its forms, it should be apparent to those skilled in the art that it is not so limited, but is susceptible to various changes without departing from the scope of the invention.

What is claimed is:

1. An automated embroidery machine, comprising:

a chassis having a computer;

a head mounted to the chassis for performing embroidery functions on a workpiece, the head having needles for sewing with different colors of thread and stitching a design on the workpiece;

a carriage assembly mounted to the chassis adjacent to the head and movable relative to the chassis in response to commands from the computer;

a sash mounted to the carriage assembly for manipulation by the carriage assembly through a range of motions, the sash having quick-release features;

a tubular frame releasably mountable to the sash via the quick-release features and adapted to support and retain a flat work workpiece; and a second frame releasably mountable to the sash via the quick-release features and adapted to support and retain a second type of workpiece that differs substantially from the flat work workpiece, the second frame being of a configuration other than a tubular frame such that both the flat work workpiece and the second type of workpiece are interchangeably mountable to the same quick-release features of the sash through their respective frames.

2. The automatic embroidery machine of claim 1, wherein the quick-release features that engage and retain the tubular frame and the second frame do not utilize threaded fasteners.

3. The automatic embroidery machine of claim 1, wherein the sash has a plurality of arms protruding therefrom, and the quick-release features comprise a spring clip and a registration pin on each of the arms, such that the arms, spring clips, and registration pins are capable of interchangeably retaining either the tubular frame or the second frame.

4. The automatic embroidery machine of claim 1, wherein the second frame is a cap frame sash.

5. The automatic embroidery machine of claim 1, wherein the second frame comprises a bracket and braces extending from the bracket, such that the braces engage the quick-release features of the sash to retain the second frame on the sash.

6. The automatic embroidery machine of claim 5, wherein each of the braces has a registration feature that is complementary to a respective one of the registration pins.

7. A system for converting an automatic embroidery machine from one type of workpiece to another type of workpiece, the system comprising:

a chassis having a computer, a head for performing embroidery functions on a workpiece, the head having needles for sewing with different colors of thread and stitching a design on the workpiece, and a carriage assembly located adjacent to the head and movable relative to the chassis in response to commands from the computer;

a first sash mounted to the carriage assembly for manipulation by the carriage assembly through a range of motions, the first sash having quick-release features;

a tubular frame releasably mountable to the first sash via the quick-release features and adapted to support and retain a flat work workpiece; and a cap frame sash releasably mountable to the first sash via the quick-release features and adapted to support and retain a head wear workpiece that differs substantially from the flat work workpiece, the cap frame sash being of a configuration other than a tubular frame such that both the flat work workpiece and the head wear workpiece are interchangeably mountable to the same quick-release features of the first sash through their respective sashes.

8. The automatic embroidery machine of claim 7, wherein the quick-release features that engage and retain the tubular frame and the cap frame sash do not utilize threaded fasteners.

9. The automatic embroidery machine of claim 7, wherein the first sash has a plurality of arms protruding therefrom, and the quick-release features comprise spring clips, registration pins, and registration sockets, such that the arms, spring clips, and registration pins and sockets are capable of interchangeably retaining either the tubular frame or the cap Same sash.

10. The automatic embroidery machine of claim 9, wherein the cap frame sash comprises a bracket and braces extending from the bracket in a same direction as the plurality of arms of the first sash, such that the braces engage respective ones of the plurality of arms and the quick-release features of the first sash to retain the cap frame sash on the first sash.

11. The automatic embroidery machine of claim 10, wherein each of the braces has registration features that are complementary to respective ones of the registration pins and sockets.

12. A method of converting an automatic embroidery machine from one type of workpiece to another type of workpiece, the method comprising:

providing the automatic embroidery machine with a computer, a head, a carriage assembly, a tubular frame supporting and retaining a flat work workpiece, and a second frame supporting and retaining a second type of workpiece that differs substantially from the flat work workpiece, the second frame having a configuration other than a tubular frame;

mounting a sash to the carriage assembly, the sash having quick-release features;

mounting either the tubular frame or the second frame to the sash via the quick-release features;

moving the carriage assembly and, thus, said either the tubular frame or the second frame, through a range of motions relative to the head for performing embroidery operations with the head on a respective one of the workpieces in response to commands from the computer;

releasing and removing said either the tubular frame or the second frame from the sash by disengaging the quick-release features;

mounting the other one of the tubular frame and the second frame to the sash via the quick-release features, such that both the flat work workpiece and the second type of workpiece are interchangeably mountable to the same quick-release features of the sash through their respective frames; and then moving the carriage assembly and, thus, said other one of the tubular frame and the second frame through a range of motions relative to the head for performing embroidery operations on the respective other one of the workpieces in response to commands from the computer.

13. The method of claim 12, wherein claims (c) and (f) comprise engaging and retaining a respective one of the tubular frame and the second frame with the quick-release features without utilizing threaded fasteners.

14. The method of claim 12, wherein step (a) comprises providing the quick-release features with a spring clip and a registration pin on each of the arms, and step (b) further comprises providing the sash with arms protruding therefrom, such that the arms, spring clips, and registration pins interchangeably retain either the tubular frame or the second frame in steps (c) and (f).

15. The method of claim 12, wherein step (a) comprises configuring the second frame as a cap frame sash.

16. The method of claim 12, wherein step (a) comprises configuring the second frame as a bracket with braces extending from the bracket, and steps (c) or (f) comprises engaging the braces with the quick-release features of the sash to retain the second frame on the sash.

17. The method of claim 16, wherein step (a) comprises configuring each of the braces with a registration feature that is complementary to a respective one of the registration pins in step (c) or (f).

* * * * *

UNITED STATES PATENT AND TRADEMARK OFFICE

CERTIFICATE OF CORRECTION

PATENT NO. : 6,694,906 B1
DATED : February 24, 2004
INVENTOR(S) : James Buck

It is certified that error appears in the above-identified patent and that said Letters Patent is hereby corrected as shown below:

Column 2,
Line 16, delete “in its place” (second occurrence)
Line 44, “Same” should read -- frame --

Signed and Sealed this

Eighth Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,694,906 B1
DATED : February 24, 2004
INVENTOR(S) : James Buck

It is certified that error appears in the above-identified patent and that said Letters Patent is hereby corrected as shown below:

Column 2,
Line 17, delete “in its place” (second occurrence)

Column 6,
Line 44, “Same” should read -- frame --

This certificate supersedes Certificate or Correction issued June 8, 2004.

Signed and Sealed this

Twenty-fourth Day of August, 2004

JON W. DUDAS
*Director of the United States Patent and Trademark Office*